US010731439B2

(12) United States Patent
Milne et al.

(10) Patent No.: US 10,731,439 B2
(45) Date of Patent: Aug. 4, 2020

(54) PREVENTION OF FLUID LOSS IN UNCEMENTED LOWER COMPLETION INSTALLATION

(71) Applicant: CONOCOPHILLIPS COMPANY, Houston, TX (US)

(72) Inventors: Ian Milne, Aberdeen (GB); Alistair Bone, Aberdeen (GB)

(73) Assignee: CONOCOPHILLIPS COMPANY, Houston, TX (US)

( * ) Notice: Subject to any disclaimer, the term of this patent is extended or adjusted under 35 U.S.C. 154(b) by 69 days.

(21) Appl. No.: 15/919,473

(22) Filed: Mar. 13, 2018

(65) Prior Publication Data

US 2018/0258738 A1 Sep. 13, 2018

Related U.S. Application Data

(60) Provisional application No. 62/470,668, filed on Mar. 13, 2017.

(51) Int. Cl.
*E21B 37/00* (2006.01)
*E21B 34/06* (2006.01)
(Continued)

(52) U.S. Cl.
CPC ..... *E21B 37/00* (2013.01); *E21B 33/12* (2013.01); *E21B 34/06* (2013.01); *E21B 43/045* (2013.01); *E21B 43/08* (2013.01); *E21B 43/10* (2013.01)

(58) Field of Classification Search
CPC ..... E21B 37/00; E21B 37/08; E21B 37/06; E21B 33/12; E21B 34/06; E21B 43/04; E21B 43/08; E21B 43/10; E21B 43/045
See application file for complete search history.

(56) References Cited

U.S. PATENT DOCUMENTS 3,850,246 A * 11/1974 Despujols ..... E21B 43/045 166/278
3,973,627 A * 8/1976 Hardy ..... E21B 36/00 166/276

(Continued)

FOREIGN PATENT DOCUMENTS

WO 20160195720 A1 12/2016

OTHER PUBLICATIONS

Clarkson, et al—"Evolution of Single-Trip Multiple-Zone Completion Technology: How State-of-the-Art New Developments Can Meet Today's Ultra Deepwater Needs", 2008, SPE 116245, SPE Annual Technical Conference and Exhibition, Sep. 21-24, Denver, CO; 17 pgs.

(Continued)

*Primary Examiner* — David Carroll
(74) *Attorney, Agent, or Firm* — ConocoPhillips Company

(57) ABSTRACT

The invention relates to a method and apparatus for avoiding fluid loss during installation of a lower completion in an open hole oil, gas or water well. A lower completion assembly 3, 33 comprising tubing with production perforations, for example in a sand screen, is run into the well on drill pipe 8, 38. The lower completion 3, 33 is hung from a packer 4, 34, together with a wash pipe 9, 39 which extends through the inner of the lower completion 3, 33. At the proximal end of the lower completion is a seal 15, 45 through which the wash pipe 9, 39 extends. An aggressive breaker fluid is circulated through the wash pipe, through a float shoe 11, 41 at the end of the completion. Once circulation is completed, the aggressive breaker removes all filter cake from the formation in 30 minutes. The wash pipe 9 is withdrawn but, because the wash pipe 9 seals against the seal 14 as it is withdrawn, fluid is not lost into the formation via the lower completion. The wash pipe 9 is made from (Continued)

flush jointed tubing which allows the seal to be uninterrupted as the wash pipe is withdrawn.

18 Claims, 2 Drawing Sheets

(51) Int. Cl.

| | |
|---|---|
| ***E21B 33/12*** | (2006.01) |
| ***E21B 43/08*** | (2006.01) |
| ***E21B 43/10*** | (2006.01) |
| ***E21B 43/04*** | (2006.01) |

(56) References Cited

U.S. PATENT DOCUMENTS

| | | | | |
|---|---|---|---|---|
| 4,733,723 | A | 3/1988 | Callegari, Sr. | |
| 5,062,484 | A | 11/1991 | Schroeder, Jr. et al. | |
| 6,073,696 | A | 6/2000 | Ellis | |
| 6,202,742 | B1 | 3/2001 | Echols | |
| 6,311,772 | B1 * | 11/2001 | Myhre | E21B 33/124 166/278 |
| 7,204,316 | B2 | 4/2007 | Dusterhoft et al. | |
| 2001/0036905 | A1 * | 11/2001 | Parlar | C09K 8/52 507/200 |
| 2014/0131051 | A1 * | 5/2014 | Pratt | E21B 19/06 166/380 |
| 2017/0138158 | A1 * | 5/2017 | Bourgneuf | E21B 33/12 |

OTHER PUBLICATIONS

Ross, Colby M., et al—"Current Materials and Devices for Control of Fluid Loss", 1999, Society of Petroleum Engineers, SPE 54323; 16 pgs.

International Search Report, PCT/US2018/022196, dated Jun. 18, 2018; 3 pgs.

* cited by examiner

PREVENTION OF FLUID LOSS IN UNCEMENTED LOWER COMPLETION INSTALLATION

CROSS-REFERENCE TO RELATED APPLICATIONS

This application is a non-provisional application which claims benefit under 35 USC § 119(e) to U.S. Provisional Application Ser. No. 62/470,668 filed Mar. 13, 2017, entitled "PREVENTION OF FLUID LOSS IN UNCEMENTED LOWER COMPLETION INSTALLATION," which is incorporated herein in its entirety.

STATEMENT REGARDING FEDERALLY SPONSORED RESEARCH OR DEVELOPMENT

None.

FIELD OF THE INVENTION

The invention relates to the completion of open hole oil, gas and water wells, including the completion of wells using un-cemented tubulars designed for controlling solids production, or enhancing productivity.

BACKGROUND OF THE INVENTION

When an oil or gas well is completed it may be necessary to install tubulars designed to control solids that may be produced as a result of the production of hydrocarbons or water. Common types of tubulars that may be used are pipes with slots or holes alone or in combination with a metal mesh or wrapped wire with defined apertures. Additional methods of solids control include prepacked sand, porous matrix around the tubing or placement of specific designed particles as a filter medium i.e. sand or gravel; commonly referred to as gravel packs. However, in all cases a lower completion which has apertures in its side wall needs to be installed in the open hole region of the well.

The lower completion is normally run on drill pipe with an inner string inside the lower completion, called a wash pipe, that allows circulation through the drill pipe and wash pipe exiting at the base of the completion. A fluid path through the tubing may be required, for example, to drive a motor at the end of the tubing, allow circulation to assist with moving the tubing to the bottom of the hole, drive other devices to enable movement of the tubing by reducing friction i.e. agitators, create circulation to remove any undesirable fluids that may enter the wellbore, place other fluids in the wellbore that may be required as part of the operation, place the chemical treatment to remove the material on the face of the wellbore or place the filter medium.

The primary purpose of the wash pipe is as a conduit for completion fluids to enable the lower completion to be washed to the bottom of the hole and also for placement of a filter cake breaker or other fluids.

The filter cake breaker is a chemical designed to remove the filter cake material placed across the formation during the drilling process as this may inhibit the future flowing productivity of the reservoir formation, as well as block the apertures of the mesh, slots or holes in the lower completion when the oil and/or gas is produced. If the filter cake is not removed, then it could dislodge from the sand face (the formation) during production and plug the production apertures in the lower completion causing production impairment. The filter cake breaker may also be required to remove any damage to the production matrix that occurred during the drilling process.

The chemicals used for material removal could be; acids, acid forming chemicals, solvents, surfactants, enzymes, oxidizing agents, catalysts, polymers, brines, biocides, corrosion inhibitors.

Once the lower completion, including any solids control tubing, is placed in the required position within the wellbore, and any chemical treatment conducted, it is then necessary to recover the drill pipe/inner stubbing (wash pipe) installation string to the surface, which includes removal of the inner tubing (wash pipe) to enable fluid to pass from the wellbore into the lower completion, via the solids control tubing if present. The chemical treatment needs to be aggressive enough to adequately remove the filter cake material placed across the formation during the drilling process, however this often comes with an undesirable consequence of reacting very quickly, resulting in fluid from above the completion being on continual losses to the area where the material has been removed.

It is common that the fluid that is above the lower completion is brine or water however it can also be the original fluid used to drill the wellbore or other fluids required as part of the operation. The brine or water contains additional chemicals that may include but not limited to, lubricants, biocides, oxygen scavengers, corrosion inhibitors.

Whilst the rate of loss of this fluid can remain within acceptable limits, this is not always the case. In fact, losses have always been a major problem and can be both costly and have well control implications.

Fluid being lost to the zone may cause damage to the zone thereby impairing movement of the hydrocarbons into the wellbore. If losses occur then there are limited options that can either lead to a) further formation damage, b) additional workover costs, c) loss of the well. Remedial steps to control loss may include placement of material back into the wellbore that will plug the formation to which the losses are going, or plug the holes, slots or mesh of the tubing.

It is preferable not to have to take remedial steps and therefore a method of preventing the losses when removing the wash pipe is needed.

During the completion design process it is possible to add 'safe zones' that enable the wash pipe to be pulled to a point where the annulus can be isolated thereby stopping the loss. A 'safe zone' is a zone that has a smooth metal face in the lower completion where rubber seals mounted on the wash pipe can engage to form a seal from the annulus.

These safe zones are only used to enable remedial material to be prepared or to replenish fluid supplies. Most drilling contractors will not allow the wash pipe to be pulled if the well is on losses.

A wash pipe is commonly 5,000 feet long and may take some 5 hours to withdraw. For this reason relatively mild breaker chemicals are used, which will take at least five hours following the end of circulation of the fluid to completely remove the filter cake. In this way, substantial fluid losses are prevented since the filter cake is not removed until after the wash pipe is withdrawn. However, more aggressive breakers are preferred which break down the filter cake in as little as half an hour or less after circulation has finished. Aggressive breakers remove the filter cake more reliably which can result in improved production. Wash pipes can be as short as 2,000 ft or can be much longer than 5,000 ft.

There is therefore an unmet need for some way of using aggressive breaker chemicals without risking excessive fluid losses.

There have been many designs proposed which provide a way to seal the annulus between the wash pipe and the lower completion at a given point or over a short length of the wash pipe ("safe zones"). See, for example, Clarkson, et al., "Evolution of Single-Trip Multiple-Zone Completion Technology: How State-of-the-Art New Developments Can Meet Today" SPE Annual Technical Conference and Exhibition, 21-24 September, Denver, Colo., USA (2008). Other approaches to controlling fluid loss have included placing a sealing material over the sand screen apertures which may be removed by chemical means—see U.S. Pat. No. 7,204,316 (Dusterhoft).

BRIEF SUMMARY OF THE DISCLOSURE

The invention more particularly includes a method of performing an open hole completion in an oil, gas or water well, the method comprising: a) delivering into an open hole region of the well a wash pipe and a lower completion assembly having (pre-formed) production apertures in its side wall; b) circulating fluid through the wash pipe to a distal end of the lower completion assembly and into an annular space around the lower completion assembly; c) withdrawing the wash pipe through a seal mounted to the lower completion assembly adjacent a proximal end of the assembly; wherein the exterior of the wash pipe remains in sealing contact with the seal as the wash pipe is withdrawn over more than 80% (e.g. 80% to 100% or 80% to 99%), optionally more than 90% (e.g. 90% to 100% or 90% to 99%), optionally more than 95% (e.g. 95% to 100% or 95% to 99%), optionally more than 99% (e.g. 99% to 100%), optionally over substantially all of the length of the wash pipe.

In some embodiments a portion of the wash pipe at the distal and/or another near the proximal end may be of reduced diameter for reasons which will be explained below. The reduced diameter regions do not make a seal with the seal referred to above but, when in registry with the seal, leave a gap between the wash pipe and seal. The reasons for this are explained below. The length of the reduced diameter portions is largely independent of the overall length of the wash pipe. Therefore, for a relatively short wash pipe, may comprise a relatively large percentage of the length of the was pipe, such as 10%. For longer wash pipes this percentage may be much lower, e.g. 1%. Some designs according to the invention do not have reduced diameter parts, and for these designs it may be possible for the sealing contact to be maintained for more than 99%, or all or substantially all of the length of the wash pipe.

As described above, the wash pipe may be withdrawn without the risk of substantial volumes of fluid being lost into the formation, since there is no communication betweenthe interior of the casing and the interior of the lower completion for all or substantially all, or most of the time the wash pipe is being withdrawn.

Optionally, the wash pipe has a substantially contiguous outer surface which facilitates the maintenance of sealing contact with the seal in the lower completion. The wash pipe may comprise flush jointed pipe since this type of pipe has a substantially contiguous outer surface. By "substantially contiguous outer surface" is meant an outer surface free from irregularities large enough to interrupt the seal.

Commonly, the lower completion assembly comprises a sand screen. However, the invention is useful in any lower completion where production fluids need to flow through pre-formed apertures in the side of the lower completion tubing. Sometimes, a gravel pack is placed by means of circulating a slurry of fluid through the lower completion.

The fluid may comprise a breaker to remove filter cake from rock formation in the open hole region, although many other types of fluid may be circulated. One of the great benefits of the invention is that an aggressive strong concentration breaker may be circulated which breaks down the filter cake very effectively and quickly. For example, an aggressive breaker may remove the filter cake in less than an hour, for example within a time period of between 10 and 120 minutes following circulation of the breaker being stopped, or between 20 and 60 minutes, or between 30 and 50 minutes. For a typical ~4,000 ft open hole section, it normally takes 5 hours or so to withdraw the wash pipe and close the fluid loss device. Removing the filter cake in, e.g., less than an hour would result in fluid losses; the invention avoids this or at least substantially reduces any such losses.

During withdrawal of the wash pipe, fluid may flow through a one-way bypass valve associated with the seal. As the wash pipe is withdrawn, fluid is passed down the wash pipe to replace the volume previously occupied by the pipe. If more fluid than necessary is pumped, the one-way valve provides a route for this fluid to return to the surface and for the correct pressure balance to be maintained.

Installation of the lower completion assembly normally includes passing down the well a packer to which is mounted both the lower completion assembly and the wash pipe in a concentric arrangement, and installing the packer at or adjacent the distal end of a length of casing within the well. This means the lower completion and wash pipe can be placed in one procedure; also since the wash pipe may have one or more enlarged regions (collets) for closing valves and since pulling these through the seal may damage it, it is preferable to have the wash pipe already installed in the lower completion when the lower completion is placed.

The invention includes an apparatus for performing an open hole completion in an oil, gas or water well, the apparatus comprising: a) a lower completion assembly having (pre-formed) production apertures in its side wall; b) a wash pipe extending through the assembly to a point at or adjacent the distal end of the lower completion assembly; c) a first internal seal located proximally in relation to the said production apertures (optionally adjacent the proximal end of the lower completion assembly), through which the wash pipe extends; d) wherein the wash pipe has a substantially contiguous outer surface over at least 80% (e.g. 80% to 100% or 80% to 99%) of its length, optionally more than 90% (e.g. 90% to 100% or 90% to 99%), optionally more than 95% (e.g. 95% to 100% or 95% to 99%), optionally more than 99% (e.g. 99% to 100%), optionally over substantially all of the length of the wash pipe whereby the wash pipe is able to be drawn through the first internal seal whilst maintaining sealing contact between its outer contiguous surface and the seal.

The wash pipe may be between 2,000 and 10,000 feet long, such as between 3,000 and 7,000 feet long.

Optionally the apparatus further comprises a seal assembly comprising the first internal seal and also a one-way bypass valve which allows flow only in the direction from the lower completion to the surface. Optionally the wash pipe and lower completion assembly are both mounted to a packer. The lower completion assembly may also comprise a second internal seal at or adjacent its distal end through which the wash pipe passes.

The wash pipe may have valve actuating formation, such as an enlarged diameter region, located immediately proximal of the second internal seal, and the lower completion assembly may comprise an isolation valve immediately distal of the internal seal which may be actuated by the valve actuating formation of the wash pipe passing through it. Optionally, one or more further internal seals may be provided along the length of the lower completion assembly.

The apparatus may further comprise a float shoe assembly at the distal end of the completion assembly through which fluid may pass into the open hole, and a seal on one or both of the float shoe assembly and the wash pipe whereby the wash pipe may make a seal with the float shoe assembly whilst fluid is delivered through the wash pipe into the open hole. The seal may be made within the wash pipe. The float shoe assembly may comprise a tube capable of projecting into the distal end of the wash pipe and making a seal with the interior of the wash pipe.

The wash pipe may have a first reduced diameter portion at its distal end, over which portion the diameter is reduced sufficiently to make no seal with the first internal seal when the said first reduced diameter portion is in registry with the seal. This first reduced diameter portion may have a length of between 5 and 300 feet, such as between 10 and 100 feet, e.g. between 30 and 80 feet, e.g. approximately 60 feet (the length of two standard joints of wash pipe).

The wash pipe may have a second reduced diameter portion in the region of its proximal end, over which portion the diameter is reduced sufficiently to make no seal with the first internal seal when the said second reduced diameter portion is in registry with the seal. The second reduced diameter portion may have a length of between 5 and 200 feet, such as between 10 and 100 feet, e.g. between 20 and 50 feet, e.g. about 30 ft (the length of one standard joint of wash pipe).

The lower completion assembly may comprise a return circulation (recirculation) aperture (upper port) in its side wall located between the seal assembly and the proximal end of the assembly, and the wash pipe may have a further valve actuating formation, such as a further enlarged diameter region (or shifting tool), located between the seal assembly and the return circulation aperture; the return circulation aperture may include a closing mechanism which may be actuated by the further valve actuating formation of the wash pipe passing through it.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
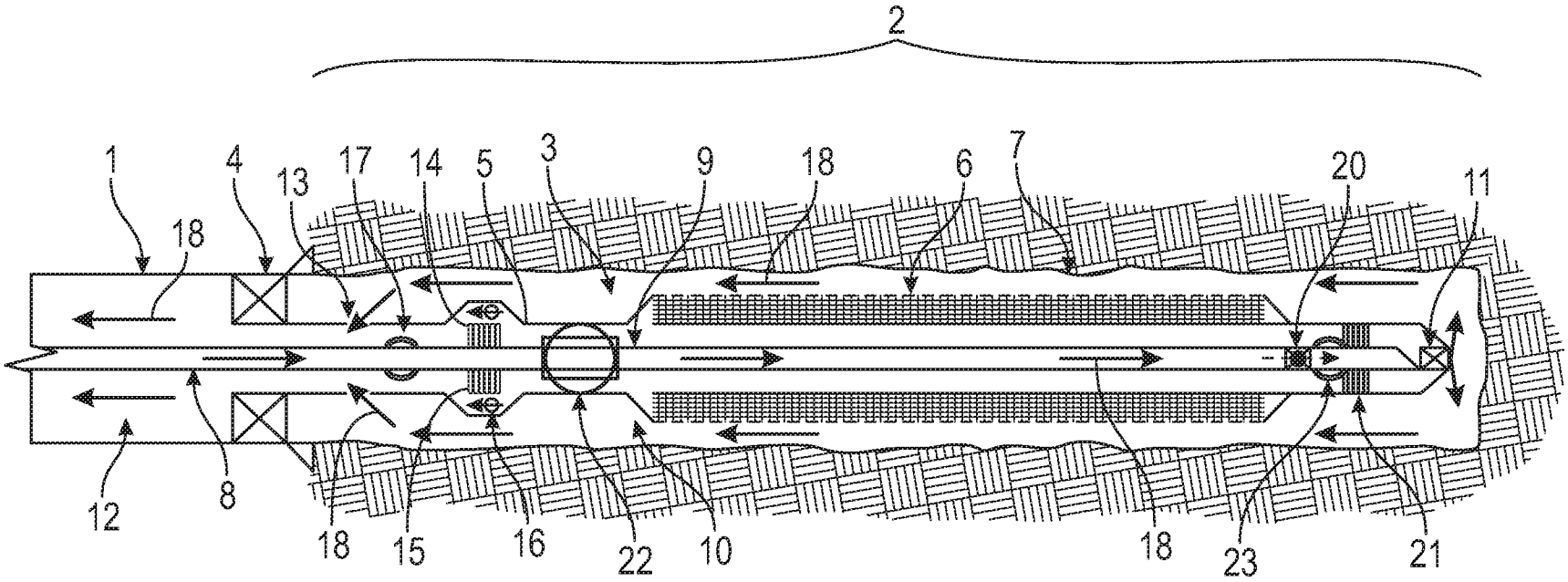
FIG. 1 is schematic section of a well showing the open hole region and a first embodiment of lower completion assembly and wash pipe in accordance with the invention.

The overall process for installing the lower completion in an open hole well is as follows, referring to a first embodiment of the invention as shown in FIG. 1. Referring to FIG. 1, first a wellbore is drilled and, normally, lined with steel casing 1. Then, a final open hole section 2 of wellbore is drilled and left un-cased. A lower completion assembly 3 is then run into the open hole section 2 on drill pipe 8. The lower completion assembly 3 comprises a packer 4 installed at the end of the casing 1 and which from which hangs tubing 5 which is fitted with various valves and seals and also the sand screen elements 6. The packer 4 isolates the annulus 10 between the lower completion assembly 3 and the rock formation 7 from the interior of the casing 1. The lower completion assembly 3 extends almost to the end of the open hole section of the wellbore.

Drill pipe 8 is attached to a packer setting tool (not shown) in the packer. Also attached to the packer setting tool is a length of wash pipe 9 which passes all the way down the interior of the lower completion assembly 3, almost to the end of the wash pipe assembly. For clarity, in FIG. 1 the drill pipe 8 and wash pipe 9 are shown as being one length of pipe. At the lower (distal) end of the lower completion assembly 3 is a float shoe 11, which is a one way valve allowing fluid to pass from the interior of the lower completion 3 out into the annulus 10, but not to pass in the other direction.

Breaker fluid, shown by arrows 18 in FIG. 1, is passed down the drill pipe 8, though the wash pipe 9 and out of the end of the lower completion assembly 3 via the float shoe 11. The breaker fluid passes back up the annulus 10 and re-enters the lower completion assembly through an upper port, or return circulation aperture, 13 which is closable. The fluid is recirculated back to the surface via the annulus 12 between the drill pipe 8 and casing 1. At the lower end of the lower completion assembly 3, mounted on the inner surface of the lower completion 3 is shoe seal stack 21 which seals against the outer diameter of the wash pipe 9. This prevents fluid passing out of the end of the wash pipe 9 from passing directly back up the interior of the lower completion assembly 3 instead of circulating through the annulus 10. A valve 20 within the wash pipe prevents any possibility of fluid flowing up the wash pipe.

Breaker fluid is circulated to be spotted inside the open hole (e.g. circulated at a rate of about 4 bbl/minute). Once this process is finished, the drill pipe 8 and wash pipe 9 need to be pulled out of the well in preparation for the well to go into production. An aggressive breaker fluid is used which is estimated to remove fully the filter cake in less than an hour (e.g. within 30-40 minutes) after circulation has finished. The danger at this point is that the formation surface, after having had the filter cake removed, will be permeable and fluid can be lost into the formation. Therefore the interior 12 of the casing 1, which is filled with fluid (normally brine or an oil or water based drilling mud), must be kept isolated from the interior of the lower completion assembly to avoid loss of this fluid to the formation via openings in the sand screen elements 6. Such loss of brine or drilling mud can damage the formation and impair production.

Normally this means removing the wash pipe before the filter cake has been completely removed. The wash pipe is 4,000 ft long the withdrawal typically takes about 5 hours, which is plenty of time to lose a large volume of fluid into the formation; for this reason it is normally not possible to use an aggressive breaker and instead a milder breaker would be used which would not remove the filter cake for 5 hours or more, allowing the wash pipe to be withdrawn before fluid can be lost to the formation. A problem is that milder breakers may not remove the filter cake as reliably as aggressive ones.

Turning again to FIG. 1, an upper port closing tool (return circulation aperture closing tool) is shown at 17. This is essentially an enlarged diameter region (shifting tool) on the wash pipe 9 which, as the wash pipe starts to be withdrawn, engages a closing sleeve (not shown) which shuts off the upper port so that the upper port does not provide a leakage path for fluid/mud from above the packer to the annulus 10. The enlarged diameter region 17 could be replaced by any suitable projection or other means on the wash pipe for activating the closing sleeve.

An upper seal assembly 14 is mounted on the interior of the lower completion assembly 3, just below (distal from) the upper port 13 and packer 4. The upper seal assembly 14 comprises a seal stack 15 and one way bypass valve 16. As the wash pipe is drawn through the seal stack 15, a seal is maintained between the wash pipe 9 and the seal stack 15. Normally, this would not be possible but the wash pipe 9 is made from flush jointed pipe which has an outer surface substantially free from irregularities which might break the seal. In this way, drilling mud (or other fluid) from above the packer 4 is kept isolated from the lower completion.

The upper seal assembly 14 also comprises a one-way bypass valve 16. As the wash pipe is withdrawn, a low pressure in the lower completion can be created. This pressure imbalance is undesirable and therefore fluid is carefully pumped down the wash pipe to fill the volume previously occupied by the wash pipe as it is withdrawn. The purpose of the bypass valve 16 is to allow any inadvertently generated excess pressure to be vented back to the interior of the casing.

Immediately below (distal of) the upper seal assembly is a fluid loss control device 22. The device 22 comprises a valve and closing sleeve actuated by a fluid loss valve closing device 23—an enlarged diameter region of the wash pipe 9 located almost at the distal end of the wash pipe, just above (proximal to) the lower seal stack 21 when the wash pipe is fully inserted into the well. Once the fluid loss valve closing device 23 has passed, and thereby actuated, the fluid loss control device 22, the wash pipe 9 is securely closed off, preventing any possibility of fluid loss.

Figure 2:
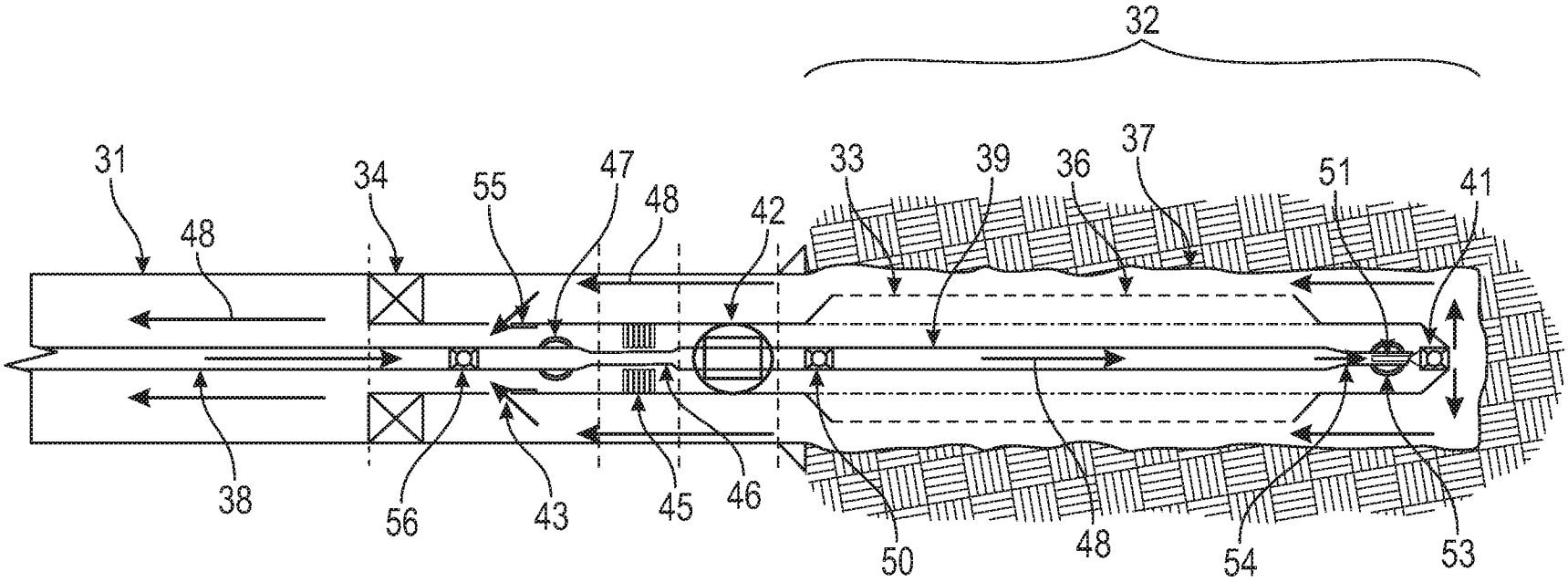
FIG. 2 is schematic section of a well showing the open hole region and a second embodiment of lower completion assembly and wash pipe in accordance with the invention.

Referring now to FIG. 2, a second embodiment comprises most features in common with the first but with some minor changes.

Suspended from a packer 34 set at the distal end of a cased region 31 of the well and extending into an open hole region 32 is a lower completion assembly 33 comprising a sand screen 36. A wash pipe 39 forms part of the lower completion and extends to a float shoe (one way valve) assembly 41 at the distal end. The float shoe 41 includes a stinger 51 approximately 30 feet in length and comprising a seal (not shown) for making a seal with the internal bore of the wash pipe. The stinger 51 is received within a narrow diameter portion 54 at the distal end of the wash pipe which is about 60 feet long.

Adjacent the proximal end of the wash pipe is an enlarged diameter region (closing tool) 47, similar to the region 17 in the first embodiment. This feature moves closing member 55 to close off the upper port 43 as the wash pipe is withdrawn.

A second reduced diameter portion 46 of the wash pipe is shown in registry with the seal stack 45, so that in the configuration of FIG. 2 the wash pipe does not form a seal with the member 45. The one-way valve 20 of the first embodiment is replaced by two one-way valves 50 and 56 which perform essentially the same function. As with the first embodiment, a fluid loss valve 42 is provided which, in use, is actuated (closed) by the enlarged diameter feature (collet shifting tool) 53 as the distal end of the wash pipe is drawn through the assembly. The bypass valve 16 of the first embodiment is omitted in the second embodiment.

In operation the second embodiment functions similarly to the first, with breaker fluid being circulated as shown by arrows 48, and then the wash pipe being withdrawn, with the wash pipe making a seal with the seal stack 45 for the majority of its length whilst it is being withdrawn.

The reduced diameter portion 46 is provided in order to facilitate assembly. A certain amount of back and forth movement of the wash pipe is required in order to assemble it, and movement of the wash pipe from left to right through the seal would be likely to damage the seal; therefore a short (30 feet or so) section of wash pipe is sized so that it does not contact the seal 45, and this allows for the required movement during assembly.

It has been found that it may be possible to omit the bypass valves 16 of the first embodiment. They are used when the wash pipe is being withdrawn if it is desired to pump in fluid to replace the volume of the pipe as it is withdrawn. However, an alternative approach is simply to allow hydrocarbons to be drawn through the sand screen and into the lower completion, which makes the bypass valves un-necessary.

As the final (distal) part of the wash pipe is withdrawn the formation (collet shifting tool) 53 closes the fluid loss control valve 42. Since the seal stack 45 is proximal to (above) this valve (which is now closed), if the wash pipe were to make a seal at this time with the seal stack 45 further wash-pipe retrieval would mean drawing a vacuum between the seal stack 45 and the fluid loss control valve 45. Hence the final part of the wash pipe is designed so that a seal is not made with the stack 42. The length of this section is about 60 feet and this length is unlikely to change for different overall lengths of wash pipe.

The second seal stack 21 of the first embodiment is replaced in the second embodiment with an internal seal stinger 51. This is because, when installing the lower completion and after the packer is set, the wash pipe must be withdrawn slightly (maybe 7 feet or so) to expose the recirculation aperture 43. This movement was found to disengage the wash-pipe from the seal stack 21 and therefore the seal was replaced with an internal one: the seal in the second embodiment is mounted on the end of a 30 feet long stinger 51 which is received inside the end of the wash pipe. When fluid is to be circulated, it is passed down the wash pipe 39, through the stinger 51 and float shoe 41 and out into the open hole 37.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. Clarkson, et al., "Evolution of Single-Trip Multiple-Zone Completion Technology: How State-of-the-Art New Developments Can Meet Today" SPE Annual Technical Conference and Exhibition, 21-24 September, Denver, Colo., USA (2008);
2. U.S. Pat. No. 7,204,316 (Dusterhoft).

The invention claimed is:

1. A method of performing an open hole completion in an oil, gas or water well, the method comprising:

a) delivering into an open hole region of the well a wash pipe and a lower completion assembly having production apertures in its side wall;

b) circulating fluid through the wash pipe to a distal end of the lower completion assembly and into an annular space around the lower completion assembly;

c) withdrawing the wash pipe through a seal mounted to the lower completion assembly adjacent a proximal end of the assembly;

d) wherein the exterior of the wash pipe remains in sealing contact with the seal as the wash pipe is withdrawn over more than 80% of the length of the wash pipe;

e) wherein, during withdrawal of the wash pipe, fluid is permitted to flow through a one-way bypass valve associated with the seal.

2. The method according to claim 1 wherein the wash pipe comprises flush jointed pipe.

3. The method according to claim 1 wherein the lower completion assembly comprises solids control tubing which provides some or all of the apertures.

4. The method of claim 1 wherein the fluid comprises a breaker and wherein the breaker removes filter cake from rock formation in the open hole region.

5. The method of claim 4 wherein, within a time period of between 10 and 120 minutes following circulation of the breaker being stopped, sufficient filter cake is removed to allow fluid exchange with the rock formation.

6. The method of claim 5 wherein the time period is between 20 and 60 minutes.

7. The method of claim 1 wherein installation of the lower completion assembly includes passing down the well a packer to which is mounted both the lower completion assembly and the wash pipe in a concentric arrangement, and installing the packer at or adjacent the distal end of a length of casing within the well.

8. Apparatus for performing an open hole completion in an oil, gas or water well, the apparatus comprising:

a) a lower completion assembly having production apertures in its side wall;

b) a wash pipe extending through the assembly to a point at or adjacent the distal end of the lower completion assembly;

c) a seal assembly located adjacent the proximal end of the lower completion assembly, through which the wash pipe extends, said assembly comprising a first internal seal and a one-way bypass valve;

d) wherein the wash pipe has a substantially contiguous outer surface over at least 80% of its length, whereby the wash pipe is able to be drawn through the first internal seal whilst maintaining sealing contact between its outer contiguous surface and the seal.

9. The apparatus of claim 8 wherein the wash pipe and lower completion assembly are both mounted to a packer.

10. The apparatus of claim 8 wherein the lower completion assembly comprises a second internal seal at or adjacent its distal end through which the wash pipe passes.

11. The apparatus of claim 10 wherein the wash pipe has an enlarged diameter region, located immediately proximal of the said second internal seal, and the lower completion assembly comprises an isolation valve immediately distal of the internal seal which is actuable by the enlarged diameter region of the wash pipe passing through it.

12. The apparatus of claim 8 comprising one or more further internal seals along the length of the lower completion assembly.

13. The apparatus of claim 8, further comprising a float shoe assembly at the distal end of the completion assembly through which fluid passes into the open hole, and a float shoe seal on one or both of the float shoe assembly and the wash pipe whereby the wash pipe is sealed with respect to the float shoe assembly whilst fluid is delivered through the wash pipe into the open hole.

14. The apparatus of claim 13 wherein the float shoe seal is made within the wash pipe.

15. The apparatus of claim 14 wherein the float shoe assembly comprises a tube or seal stinger capable of projecting into the distal end of the wash pipe and sealing with the interior of the wash pipe.

16. The apparatus of claim 8 wherein the wash pipe has a first reduced diameter portion at its distal end, over which portion the diameter is reduced sufficiently that is does not seal with the first internal seal when the said first reduced diameter portion is in registry with the said first internal seal, the first reduced diameter portion having a length of between 5 and 300 feet.

17. The apparatus of claim 16 wherein the wash pipe has a second reduced diameter portion in the region of its proximal end, over which portion the diameter is reduced sufficiently that it does not seal with the first internal seal when the said second reduced diameter portion is in registry with the first internal seal, the second reduced diameter portion having a length of between 5 and 200 feet.

18. The apparatus of claim 11 wherein the lower completion assembly comprises a return circulation aperture in its side wall located between the seal assembly and the proximal end of the assembly, and wherein the wash pipe has a further enlarged diameter region located between the seal assembly and the return circulation aperture and wherein the return circulation aperture includes a closing mechanism which is actuable by the further enlarged diameter region of the wash pipe passing through it.

* * * * *